US007861798B2

(12) United States Patent
Amherd

(10) Patent No.: US 7,861,798 B2
(45) Date of Patent: Jan. 4, 2011

(54) NEEDLE GUN

(75) Inventor: René Amherd, Wollerau (CH)

(73) Assignee: Von ARX AG, Sissach (CH)

( * ) Notice: Subject to any disclaimer, the term of this patent is extended or adjusted under 35 U.S.C. 154(b) by 562 days.

(21) Appl. No.: 11/661,238

(22) PCT Filed: Aug. 24, 2005

(86) PCT No.: PCT/CH2005/000493

§ 371 (c)(1),
(2), (4) Date: Feb. 26, 2007

(87) PCT Pub. No.: WO2006/021121

PCT Pub. Date: Mar. 2, 2006

(65) Prior Publication Data

US 2008/0185164 A1 Aug. 7, 2008

(30) Foreign Application Priority Data

Aug. 26, 2004 (CH) ..... 1399/04

(51) Int. Cl.
*B25D 9/00* (2006.01)

(52) U.S. Cl. ..... 173/200; 173/1; 15/93.1

(58) Field of Classification Search ..... 66/219; 15/93.1; 173/1, 98, 117, 93.5, 128, 131; 112/80.04; 175/297; 29/81.14, 798; 30/329–339; 451/164; 81/177.1, 427.5, 489
See application file for complete search history.

(56) References Cited

U.S. PATENT DOCUMENTS 2,923,937 A * 2/1960 Laucher ..... 227/136
4,134,193 A * 1/1979 Lenzin et al. ..... 29/81.14
4,605,073 A 8/1986 Nilsson et al.
4,630,687 A 12/1986 Dummermuth
4,723,610 A * 2/1988 Dummermuth et al. ..... 173/1
5,251,367 A 10/1993 Ward et al.
5,586,607 A * 12/1996 Neumaier et al. ..... 173/117
6,152,245 A 11/2000 Nilsson
6,244,085 B1 6/2001 Dummermuth
6,434,998 B2 8/2002 Amherd (Continued)

FOREIGN PATENT DOCUMENTS

CH 654 513 A5 2/1986

(Continued)

OTHER PUBLICATIONS

Co-Pending U.S. Appl. No. 10/548,158, filed Sep. 18, 2006; inventor René Amherd; title Press Device.

(Continued)

*Primary Examiner*—Monica S Carter
*Assistant Examiner*—Stephanie Newton
(74) *Attorney, Agent, or Firm*—Pauley Peterson & Erickson

(57) ABSTRACT

A hammer device in the form of a needle gun. The gun includes a cylinder housing containing a cylinder, in which a flying piston is displaced and an anvil, against which the piston strikes. A needle carrier is located on the anvil, and the needles of the gun are held in the carrier so that the needles can be longitudinally displaced. To reduce the wear on the needle carrier and to preserve the needle heads of the needles, the needle carrier is configured from several layers, at least in the vicinity of the guide plate. The layers are of alternating hard and soft material.

13 Claims, 2 Drawing Sheets

U.S. PATENT DOCUMENTS

| | | | |
|---|---|---|---|
| 6,510,723 | B2 | 1/2003 | Amherd |
| 6,662,621 | B1 | 12/2003 | Amherd |
| 7,036,806 | B2 | 5/2006 | Amherd et al. |

FOREIGN PATENT DOCUMENTS

| | | | |
|---|---|---|---|
| DE | 84 32 499.6 | U | 2/1985 |
| EP | 0 152 376 | B1 | 8/1985 |

OTHER PUBLICATIONS

Co-Pending U.S. Appl. No. 10/581,390, filed Apr. 12, 2007; inventor René Amherd; title Electrically Operated Pressing Tool.

* cited by examiner

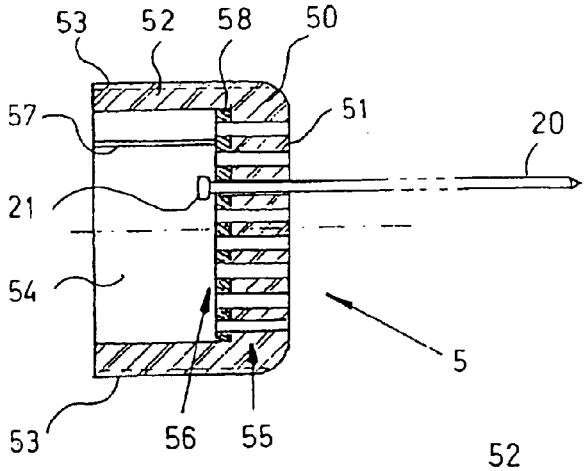
FIG. 2
FIG. 3
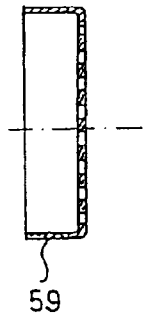
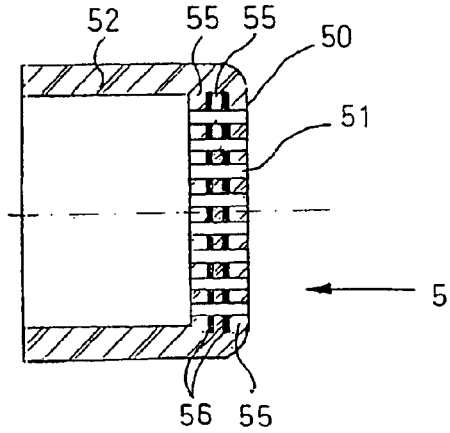
FIG. 4
FIG. 5
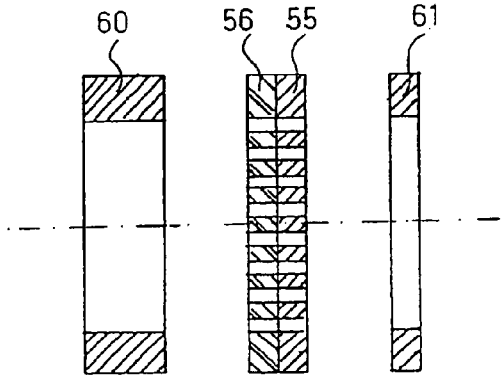

NEEDLE GUN

BACKGROUND OF THE INVENTION

1. Field of the Invention

This invention relates to a hammer device in the form of a needle gun including a cylinder housing in which a movable cylinder is mounted in a sliding manner between two compression springs, a floating piston is moved to and from in the cylinder under the influence of compressed air, and delivers a strike impulse to an anvil on which a needle carrier rests under pressure of one of the springs, and several needles in the needle carrier are mounted in an axially sliding manner and under operating pressure bear on the anvil with their needle heads at the end.

2. Discussion of Related Art

Hammer devices are commercially under the description needle guns, and have proven their worth in daily use. Basically, needle guns are used for cleaning surfaces, in order for example to remove old paint remains or rust layers. The manner of operating and the construction of the needle pistols lead to a high material loading. Accordingly, hammer devices of interest can be improved to increase their operating life.

In particular, in order to reduce the wear between the movable cylinder and the cylinder housing, a special sliding seal is known from European Patent Reference EP-A-0 152 376.

A hammer device of the initially mentioned type is likewise known from German Patent Reference DE-U-84 32 499. In this document, the main emphasis is on the extension in the operating life of the needle gun, to address the problem of the wear between the anvil and the cylinder housing.

Then, after the operating life of known hammer devices had remained practically unchanged for years, recently their have been increasing complaints with regard to the known hammer devices for not reaching the usual operating life. Although no changes occurred with regard to design, complaints suddenly appeared. On investigating the devices which were the basis of the complaints, many which had high tension masts were derusted. The investigations revealed that the persons working on the high tension masts were using the hammer device in continuous operation. The continuous operation thereby was accomplished by fixing the actuation button or the trigger lever on the grip of the needle gun with an adhesive tape, so that the needle gun no longer switched off the apparatus on letting go of the needle gun. Thus the worker on the high tension mast practically has only one free hand, and accordingly needs to immediately grab the needle gun and work with it without having to grip around it. For this, the worker has the needle gun fastened for example on a belt on a safety cable.

With usual derusting work, the worker presses the needle gun onto the surface which is to be machined, and thus the needles with their needle heads bear directly on the anvil. When not working, the needles thus hang in the needle carriers and the floating piston is stationary, so that no oscillation of the anvil is effected, and the needles are held in the needle carrier in a non-moved manner.

With the previously mentioned continuous operation with which for example the actuation lever is fastened on the grip with an adhesive tape, the floating piston then moves to and from when one does not work, and as a result of this, the needles do not bear on the anvil. Thus, the floating piston continues to emit its impulses onto the anvil, the oscillation of the anvil is transmitted onto the needle carrier. The needle carrier accordingly also oscillates, which is pressed onto the anvil by the compression spring. The oscillation of the needle carrier causes the needles to oscillate in a practically unloaded manner, and thereby impact onto the anvil which in turn provides the needles with a strike impulse. Accordingly, the needle carrier is loaded in impact by the needle heads. The needle carrier, which is usually manufactured of plastic, is not designed for this type of impact loading and is thus destroyed within a relatively short period.

SUMMARY OF THE INVENTION

It is one object of this invention to improve a hammer device so that the operating life of the apparatus is also increased in continuous operation.

This object is achieved by a hammer device with the features described in this specification and in the claims.

First attempts at solving this problem by manufacturing the needle carrier of metal have been shown to be an undesirable path. The relatively finely formed needle heads of the needles, which are manufactured of hardened or tempered steel very quickly lead to fatigue failures. In particular, the needle heads were practically separated from the needles. This problem is addressed by this invention.

BRIEF DESCRIPTION OF THE DRAWINGS

Various examples of the hammer device according to this invention are explained in the following description with reference to the accompanying drawings, wherein:

FIG. 2 shows a diametrical section taken through a needle carrier designed according to this invention, with a plate-like inlay;

FIG. 3 shows a sectional view of a cup-like inlay;

FIG. 4 shows a sectional view of a needle carrier, in which two intermediate plates are injected; and FIG. 5 shows a sectional view of a needle carrier which is merely formed as a multi-layer plate with holes and a distance ring which is arranged between the perforated plate and the anvil.

DETAILED DESCRIPTION OF THE INVENTION

Figure 1:
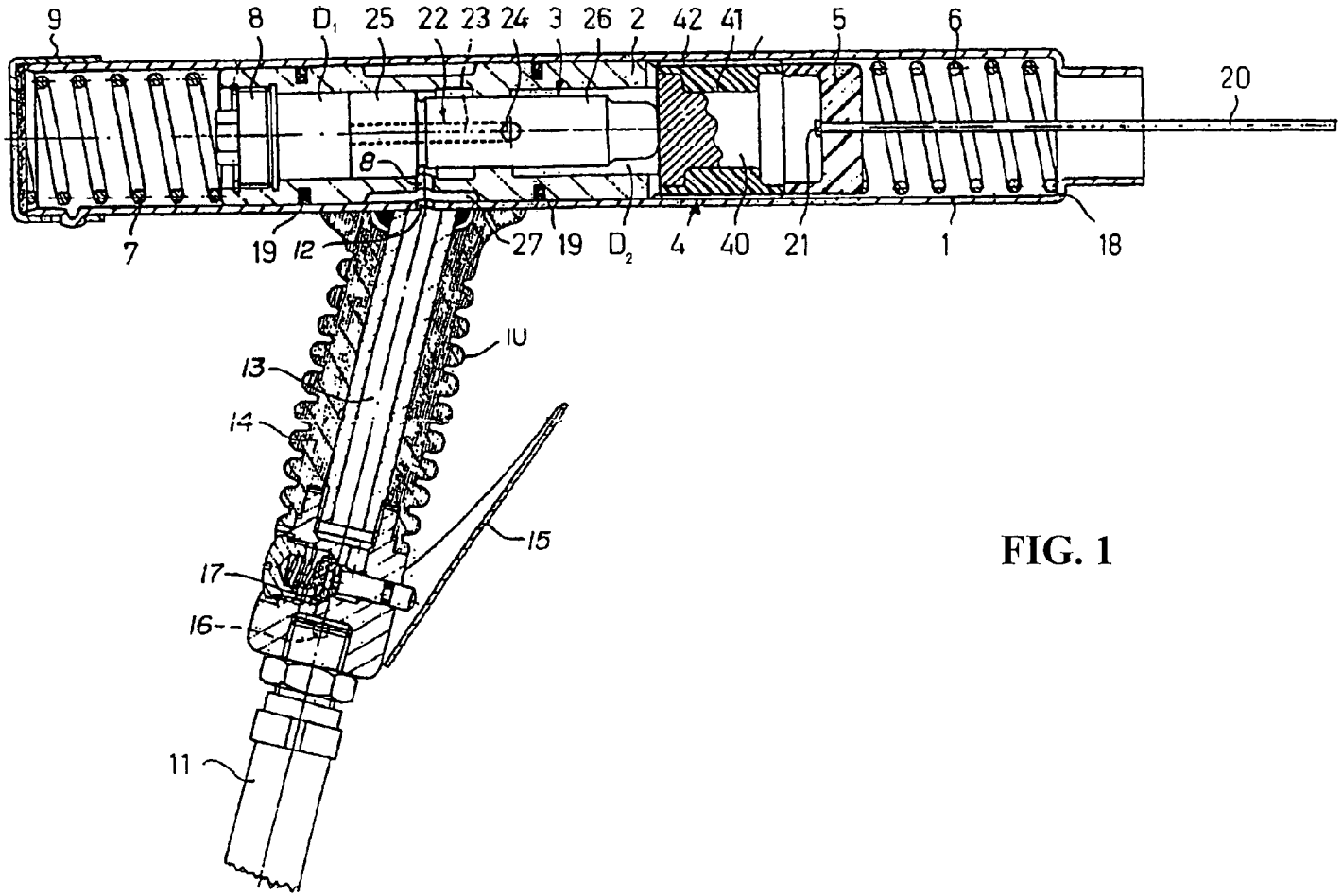
FIG. 1 shows a hammer device designed according to this invention, in the shape of a needle gun, along a central longitudinal section.

The hammer device represented is in the shape of a needle gun, and corresponds in its construction to teachings of German Patent Reference DE-U-84 32 499 or the corresponding Swiss Patent Reference CH-A-654 513. The contents of these protective rights are referred to with regard to the manner of operation. The main component of the hammer device is formed by a cylinder housing 1 which corresponds to the shape of a cylinder with a circular cross section. A movable cylinder 2 is mounted in a sliding manner in the cylinder housing 1 and is sealed with respect to the cylinder housing 1 by axial face seals 19. A floating piston 3 is mounted in the cylinder 2, and has a thickened end which runs in a first pressure chamber $D_1$, and a slimmer end of the floating piston 3 lies opposite and has a hammer-like head and moves in a second pressure chamber $D_2$. The thickened piston end is indicated at 25 and the slimmer end of the piston which is formed into a hammer head is indicated at 26. The floating piston 3 which is moved to and fro or from, in an oscillating manner, in each case hits an anvil 4. The anvil 4 has a steel core 40 and is coated with a thickened sliding ring 41 of wear-resistant plastic. Several compressed air relief grooves 42 are formed in the sliding ring 41 in the axial direction. A needle carrier 5 rests on the anvil 4 and has a roughly cup-like shape in the embodiment represented here, and has a design discussed later in this specification. The needle carrier 5 is pressed onto the anvil 4 under the pressure of the compression spring 6 and then onto the cylinder 2. The spring 6 is supported in the cylinder housing 1 on a shoulder or neck 18. A spring 7 which is accommodated in the cylinder housing 1 at the oppositely lying end, is supported on a cover 9 and lies on the movable cylinder 2. The movable cylinder 2 or its first pressure chamber $D_1$ is terminated by a cylinder cover 8. The hammer device represented functions by compressed air which is supplied from a supply lead 11 through a grip 10. The grip 10 is formed by a grip tube 12, which via an air inlet 12, is in communicating connection with the cylinder housing 1 or with the pressure chamber $D_1$, and indirectly with the second pressure chamber $D_2$. The supply lead 11 is connected to the grip tube 13 via a connection piece. A grip collar 14 is pushed over the grip tube 12. A valve 17 is arranged in the connection piece, which may be manually actuated via an actuation lever 15. The actuation lever 15 is pivotable about the lever axis 16.

A T-shaped bore 22 which includes a centric axial bore 23 and a diametrical bore 24 is incorporated in the floating piston 3. Compressed air, via the air inlet 12, gets into a peripheral air supply chamber 27 which is formed in the movable cylinder 2 and flows in the movable cylinder 2 via a bore. Here, the piston with its thickened piston end 25 is pressed in the direction of the cylinder cover 8 until the floating piston is displaced so far, that the diametric bore 24 communicates with the cylinder chamber on the air supply side, by which the compressed air flows through the centric axial bore 23 into the first compressed air chamber $D_1$ and moves the piston in the opposite direction and strikes the anvil and compressed air flows out of the first compressed air chamber $D_1$ into the second compressed air chamber $D_2$ via the T-shaped bore 22. Thus, the anvil lifts from its seat on the movable cylinder 2 and the pressurized air escapes via the relief grooves 42 which are also present on the needle carrier 5. After the compressed air relief, the spring 6 pushes the needle carrier 5, the anvil 4 and thus the piston 3 back again into the initial position and the cycle is repeated.

FIGS. 2 to 5 are referred to with regard to the design of the needle carrier 5. The needle carrier 5 comprises a guide plate 50 in which a multitude of needle guide bores 51 are formed. The needle guide bores 51 are distributed regularly over the surface of the circular guide plate 50. The distance between two adjacent needle guide bores 51 is selected so that the needle heads 21 of the needles 20 do not mutually contact. An annular wall 52 follows the guide plate 50, and this wall is connected to the needle guide plate 50 as one piece in the embodiments according to FIG. 2 and FIG. 4. The annular wall 52 comprises several axially running pressure relief grooves 53 distributed uniformly on the periphery. The annular wall 52 of the needle carrier 5 serves for mounting and guiding the needle carrier 5 in the cylinder housing 1. As a result, the needle carrier 5 as a whole has a cup-like shape, whose cup wall bears on the anvil, which is not shown. Thus a cavity 54 remains between the anvil and the guide plate 50 and this cavity is peripherally limited by the annular wall 52. The needle heads 21 of the needles 20 are located in this cavity 54. If one does not operate with the hammer device, then the needles 20 lie in the bores 51 in a guided manner so that the needle heads within the cavity 54 lie loosely on the guide plate 50. If one operates with the device, the needles 20 are pressed onto a surface to be treated and the needle heads 21 bear on the anvil. The needles 20 are set into oscillating motion under the effect of the hammer impulses of the floating piston which are transmitted via the anvil onto the needles 20. Here however, they usually execute this oscillatory movement so that the needle heads do not contact the guide plate 50 of the needle carrier 5. As initially mentioned, this situation is different when the device operates in an unloaded manner. Now the needles 20 are moved to and fro practically over the entire height of the annular wall 52, and hit the inner surface of the guide plate 50 with a correspondingly high speed. In order to avoid corresponding damage to the needles 20 and to the needle carrier 5, according to this invention, it is suggested to manufacture the needle carrier of at least two layers of material of a different hardness. Thus, the layers should be arranged perpendicularly to the running direction of the needles. In the embodiment according to FIG. 2, as mentioned, the guide plate 50 with the needle guide bores 51 arranged therein and the annular wall 52 are manufactured as one piece and for example are injected from plastic. Accordingly, the plastic base forms a first material layer 55 on which a second material layer 56 lies. This second material layer 56 in the embodiment example according to FIG. 2 is a metal plate which comprises a perforation which corresponds to the needle guide bores 51. Basically, the second material layer 56 may be laid on in a loose manner. For simplifying the assembly, it is possible to arrange at least one layer orientation bead 57 extending down to the guide plate on the inner side of the annular wall 52, and provide the second material layer 56 which is designed as a protective plate, with a correspondingly shaped notch. The second material layer 56 or the protective plate 58 may be manufactured of different materials, such as either a metal plate, using a softer material than that of the hardened needles 20 or their heads 21. Apart from relatively soft steel or iron alloys, various non-ferrous metals and their alloys or also aluminum are possible. However, it is also possible to manufacture the protective plate 58 or the second material layer 56 of a particularly high-quality plastic which is accordingly wear-resistant and impact-resistant. Plastic from the group of PBO, PA or PE is particularly suitable for this purpose. Thus, in this case both material layers 55 and 56 are of plastic. In this case, it is useful to manufacture the harder layer of a material which has a hardness of more than 50° Shore A.

It is not necessary for the harder material layer to always be that on which the needle heads 21 impact. If for example the needle carrier 5 as a whole is manufactured of a relatively hard metal, then the second material layer 56 may be manufactured of a relatively thin layer of plastic. This thin layer of plastic can be relatively highly elastic. A plastic treated coating is possible. Thus, a layer in the form of a baked finish is possible.

Instead of an inserted or bonded-in protective plate 58, the second material layer 56 may also be designed in a cup-like manner as a protective cup 59, such as shown in FIG. 3. The protective cup 59 may be shaped and punched from any sheet metal. The protective cup 59 is then pushed into the needle carrier 5 with a positive fit or a non-positive fit, so that its holes coincide with the holes of the protective cup 59.

One embodiment of the needle carrier 5 is shown in FIG. 4, wherein several first material layers 55 and several second material layers 56 alternate. The second material layers 56 can be directly injected into the needle carrier 5. In this case, practically the complete needle carrier 5 is formed as one piece, wherein the guide plate 50 together with the annular wall 52 is manufactured of the material of the first material layer, and the second material layer is injected as an inlay. In this case, with regard to manufacturing technology, it is possible to punch in the needle guide bores 51 at a later stage.

Finally, FIG. 5 shows another embodiment for the design of the needle carrier 5. The guide plate 50 is manufactured as an actual plate of at least in each case a first material layer 55 and a second material layer 56. Here, for example, there are multi-layer plates from which the guide plate 50 with the needle guide bores 51 is punched. The annular wall 52 is manufactured separately and includes a cylindrical ring which can be manufactured of plastic or metal and replaces the original annular wall 52. In this case, not only can the selection of the material of the first material layer 55 and of the second material layer 56 be freely combined, but also the support ring 60, which is manufactured separately may be manufactured of any material. Material pairings can be used to keep as low as possible material wear. If the first material layer 55 which in the installed condition is loaded by the compression spring 6, a relatively soft plastic, then one would usefully provide an intermediate ring 61 which comes to lie between the guide plate 50 and the compression spring 6.

As shown in FIG. 5, the needle carrier 5 is designed in a two-part manner, which permits the provision of material layers which have a high elasticity, by which the oscillation behavior of the needle pistol can be influenced.

The invention claimed is:

1. A hammer device in a form of a needle gun, comprising:

a cylinder housing in which a movable cylinder is slidably mounted between two compression springs, wherein a floating piston is moved to and from in the cylinder by compressed air, and delivers a hammer impulse onto an anvil;

a plurality of needles mounted in an axially sliding manner in a needle carrier and under operating pressure needle heads of the needles move off the needle carrier and into a position of contact with the anvil;

the needle carrier disposed between the anvil and one of the two springs, the needle carrier comprising a guide plate adjacent the one of the two springs and a separately manufactured support ring disposed between the guide plate and the anvil;

the guide plate manufactured of at least two layers arranged perpendicularly to a running direction of the needles, wherein a material layer of the guide plate that is closest to the anvil having at least one of a harder material or a more wear-resistant material than a material layer which follows in the axial direction of the needles.

2. A hammer device according to claim 1, wherein the material layer of the guide plate (50) closest to the anvil is of a more wear-resistant material than the material layer which follows in the axial direction of the needles.

3. A hammer device according to claim 1, wherein the needle carrier (5) is injected with a plastic, and at least one material layer is formed as an inserted metal plate.

4. A hammer device according to claim 1, wherein the harder layer is of metal.

5. A hammer device according to claim 1, wherein all layers are of plastic, and the harder layer has a shore A hardness of over 50.

6. A hammer device according to claim 2, wherein the material layer is of a wear-resistant material of a plastic selected from the group of PBO, PA and PE.

7. A hammer device according to claim 1, further comprising a separately manufactured intermediate ring disposed between the guide plate and the one of the two springs.

8. A hammer device in a form of a needle gun, comprising:

a cylinder housing in which a movable cylinder is slidably mounted between two compression springs, wherein a floating piston is moved to and from in the cylinder by compressed air, and delivers a hammer impulse onto an anvil;

a needle carrier comprising a cup disposed between the anvil and one of the two compression springs, the needle carrier including a guide plate and a protective layer and defining a space between the anvil and the protective layer, the protective layer formed as a protective plate or a protective cup inserted into the cup of the needle carrier, the protective layer having at least one of a harder material or a more wear-resistant material than the guide plate, wherein the guide plate and the protective layer have matching patterns of perforations for receiving needles, and an annular wall of the cup has a longitudinally extending orientation bead for engaging with the protective layer to provide a positioned insertion of the protective layer;

a plurality of needles mounted in an axially sliding manner within the perforations of the guide plate and the protective layer, the needles including needle heads movable within the space between the protective layer and the anvil, wherein under an operating pressure during use the needle heads move within the spacing off the protective plate and into a position to contact the anvil.

9. A hammer device according to claim 8, wherein the cup of the needle carrier (5) has two parts-including a guide plate (50) of at least two material layers (55, 56) and a support ring (60) which is manufactured separately.

10. A hammer device according to claim 8, wherein the cup of the needle carrier (5) is of one piece, and a peripheral annular wall (52) is integrally formed on the guide plate (50) and has a free end positioned on the anvil (4).

11. A hammer device according to claim 10, wherein the cup of the needle carrier (5) is injected from a plastic and a thin-walled protective cup (59) of metal, fitting with a positive fit, is insertable and forms a second material layer (56).

12. A hammer device according to claim 10, wherein the cup of the needle carrier (5) forms a first material layer (55) and the protective plate (58) forms a second material layer (56).

13. A hammer device according to claim 10, wherein the annular wall (52) has an orientation bead (57) which permits a positioned insertion of one of the protective cup (59) and the protective plate (58) into the needle carrier (5).

* * * * *